US010094075B2

(12) United States Patent
Keen

(10) Patent No.: US 10,094,075 B2
(45) Date of Patent: Oct. 9, 2018

(54) ARRIS PROTECTION JOINT

(71) Applicant: Permaban Limited, Ivybridge, Devon (GB)

(72) Inventor: Andrew Keen, Ivybridge (GB)

(73) Assignee: Permaban Limited, Devon (GB)

( * ) Notice: Subject to any disclaimer, the term of this patent is extended or adjusted under 35 U.S.C. 154(b) by 0 days.

(21) Appl. No.: 15/310,658

(22) PCT Filed: May 11, 2015

(86) PCT No.: PCT/GB2015/051373
§ 371 (c)(1),
(2) Date: Nov. 11, 2016

(87) PCT Pub. No.: WO2015/173549
PCT Pub. Date: Nov. 19, 2015

(65) Prior Publication Data

US 2017/0081805 A1 Mar. 23, 2017

(30) Foreign Application Priority Data

May 12, 2014 (GB) ..... 1408398
Feb. 24, 2015 (GB) ..... 1503059

(51) Int. Cl.
*E04B 1/682* (2006.01)
*E01C 11/14* (2006.01)
(Continued)

(52) U.S. Cl.
CPC ..... *E01C 11/14* (2013.01); *E01C 11/106* (2013.01); *E04B 5/32* (2013.01); *E04G 23/0288* (2013.01)

(58) Field of Classification Search
CPC .... E01C 11/14; E01C 11/106; E04G 23/0288; E04B 5/32
(Continued)

(56) References Cited

U.S. PATENT DOCUMENTS 2,181,623 A * 11/1939 Klein ..... E01C 11/14 404/63
2,365,550 A * 12/1944 Heltzel ..... E01C 11/12 404/59
(Continued)

FOREIGN PATENT DOCUMENTS

GB 2 494 760 A 3/2013
GB 2 5000 626 A 10/2013
(Continued)

*Primary Examiner* — Basil S Katcheves
(74) *Attorney, Agent, or Firm* — Bay State IP, LLC

(57) ABSTRACT

The joint comprises a pair (12, 14) of complementary engineering grade polymer injection moldings. Each molding is comprised of generally equal length oblique webs (15), set at 60° to a mid-plane (16) of the assembled joint, shorter, inner webs (17) and a longer, outer webs (18). Centrally of each outer web (18) is an aperture (21) and centrally of each inner web is a pin (22) with a step (23) and a pointed head (24). The heads of one molding clip into the apertures of the other while the steps determine their separation gap (25). The trapezium wave shape of the joint provides re-entrants (31) from the plane of the outer webs (18) towards that of the inner webs. Outwards of the re-entrants extend anchoring formations (33). Behind each re-entrant these formations are joined by a tab (34).

20 Claims, 14 Drawing Sheets

(51) Int. Cl.
*E01C 11/10* (2006.01)
*E04B 5/32* (2006.01)
*E04G 23/02* (2006.01)

(58) Field of Classification Search
USPC ..... 52/396.02, 396.04; 404/60
See application file for complete search history.

(56) References Cited

U.S. PATENT DOCUMENTS 3,437,017 A * 4/1969 Walz ..... E04C 5/04 404/60
3,440,934 A * 4/1969 Dill ..... E01C 11/02 404/65
3,732,788 A * 5/1973 Brown ..... E01D 19/06 404/64
4,522,531 A * 6/1985 Thomsen ..... E01C 11/04 404/2
5,337,532 A * 8/1994 Reid ..... E04C 5/18 248/163.1
5,366,319 A * 11/1994 Hu ..... E01C 11/14 404/52
5,487,249 A * 1/1996 Shaw ..... E04B 1/483 404/60
6,354,053 B1 * 3/2002 Kerrels ..... E01O 5/08 404/47
8,677,712 B1 * 3/2014 Edmonds, Jr. ..... E01C 11/14 165/53
2005/0166513 A1 * 8/2005 Vanderhoef ..... E04F 15/105 52/578

FOREIGN PATENT DOCUMENTS

JP S56 64003 6/1981
WO 2013057299 4/2013
WO 2013127812 A2 9/2013

* cited by examiner

ARRIS PROTECTION JOINT

CROSS REFERENCE TO RELATED APPLICATION

This application is for entry into the U.S. National Phase under § 371 for International Application No. PCT/GB2015/051373 having an international filing date of May 11, 2015, and from which priority is claimed under all applicable sections of Title 35 of the United States Code including, but not limited to, Sections 120, 363, and 365(c), and which in turn claims priority under 35 USC 119 to British Patent Application No. 1408398.4 filed on May 12, 2014 and British Patent Application No. 1503059.6 filed on Feb. 24, 2015.

The present invention relates to an arris protection joint for edging the arrises of cured material poured on opposite sides of the joint prior to curing.

Such joints find use as a free movement, arris protection, construction joint—also referred to simply as a movement joint—for dividing concrete during pouring and cured concrete slabs on opposite sides of the joint. They also find use as a repair joint for use in line with a discontinuity between two concrete slabs in repairing an erosion cavity with curable repair material poured on opposite sides of the joint. The discontinuity requiring repair may be at a join between two slabs having no movement joint, a saw cut in a slab or indeed a movement joint that has failed.

In our International Application No. PCT/GB2012/000694, we described and claimed:

A free movement, arris protection, construction joint for dividing the concrete during pouring of slabs on opposite sides of the joint, the joint having a top-to-bottom depth in its use orientation, giving this depth to the slabs, the joint comprising:

a pair of elongate fabrications one for each side of the joint and means for frangibly connecting the formations together, the fabrications including:

means for anchoring them in the respective concrete slabs on opposite sides of the joint, arris protection members for the respective concrete slabs at each side of the joint, the arris protection members being complementarily formed along the length of the joint with a regular wave shape, with each member extending regularly across a mid-plane of the joint from one side to the other and back again at successive positions along the joint at least whilst the fabrications remain frangibly connected, at least one of them having width transverse the length of the joint giving the joint its top-to-bottom depth and being configured to act as a divider for dividing the concrete slabs and the regular wave shape extending throughout the depth of the arris protection members, including the or each dividing one, whereby on pouring the slabs are formed with interdigitated concrete fingers edged at their arrises by the arris protection members and extending through the depth of the slabs.

In our British patent application No 1408398.4 we have described a repair joint for use in line with a discontinuity between two concrete slabs in repairing an erosion cavity with repair material placed on opposite sides of the joint, the joint comprising:

an opposed pair of elongate arris members for edging the repair material, the arris members being:

complementarily formed along the length of the joint with a regular wave shape, with each member extending regularly across a mid-plane of the joint from one side to the other and back again at successive positions along the joint, the mid-plane being in use generally aligned with the discontinuity, whereby on placement of the repair material it is formed into inter-digitated fingers edged by the arris members and extending at least for the depth of the repair joint, corresponding to the width of the arris members and the arris members having:

means for anchoring them in the respective repair material on opposite sides of the joint and adaptations enabling their support in the cavity with their top at least substantially flush with the concrete slabs and adjustable supports for co-operating with the adaptations of the arris members for their support in the cavity.

In our British patent application No 1503059.6 we have described a free movement, arris protection, construction joint for dividing the concrete during pouring of slabs on opposite sides of the joint, the joint having a top-to-bottom depth in its use orientation, giving this depth to the slabs, the joint comprising:

a pair of arris members one for each side of the joint, the members including:

means for anchoring them in the respective concrete slabs on opposite sides of the joint, arris protection members for the respective concrete slabs at each side of the joint, the arris protection members being complementarily formed along the length of the joint with a regular wave shape, with each member extending regularly across a mid-plane of the joint from one side to the other and back again at successive positions along the joint at least on pouring of concrete, at least one of them having width transverse the length of the joint giving the joint its top-to-bottom depth and being configured to act as a divider for dividing the concrete slabs and the regular wave shape extending throughout the depth of the arris protection members, including the or each dividing one, whereby on pouring the slabs are formed with interdigitated concrete fingers edged at their arrises by the arris protection members and extending through the depth of the slabs and at least one dowel extending transversely at dowel apertures through the arris members for maintaining the slabs on either side of the joint level in use; characterised in that:

the arris members are moulded of polymeric material.

The present application claims priority from and seeks to protect the subject matter of these two applications, including their common subject matter. It should be noted that herein concrete as poured on either side of a movement joint and repair material as poured on either side of a repair joint is referred to as pourable material, regardless of whether it is easily pourable or more difficult to pour possibly requiring trowelling for placement.

The object of the present invention is to provide an improved arris protection joint.

According to one aspect of the invention there is provided an arris protection joint for edging the arrises of cured material pourable on opposite sides of the joint prior to curing, the joint comprising: an opposed pair of elongate arris members for edging the cured material, the arris members being:

complementarily formed along their length with a wave shape, with each member extending across a mid-plane of the joint from one side to the other and back again at successive positions along the joint, whereby on pouring of the curable material it is formed into interdigitated fingers edged by the arris members and extending through the depth of the material, corresponding to the width of the arris members, and the arris members having:

means for anchoring them in the respective repair material on opposite sides of the joint and adaptations enabling their support in the cavity with their top at least substantially flush with the concrete slabs and the arris members are of moulded polymeric material and supports complementary with the adaptations of the arris members for their support in the cavity.

Preferably, the wave form is regular and each arris member's extent across the mid-plane is regular.

The arris members can be complementarily shaped so as to abut each other when set up for use prior to concrete pouring. However normally, the arris members have integrally moulded spacers for holding them at a separation which is small in comparison the extent of the wave form, preferably less than 10 mm and typically approximately 5 mm. The spacers can have complementary clips for holding the arris members together prior to use. The arris protection joint can include a filler between top-in-use edges of the arris members.

Conveniently, the wave form is constant across the width of the arris members, providing in use interdigitated fingers of cured material having a constant depth. However, it can be envisaged that the wave form could vary across the width of the arris members, providing a varying form to the interdigitated fingers.

Normally, the arris members will be moulded of filled polymer, preferably glass filled nylon. The moulded members can have a length between 1 and 1.5 meters and preferably between 1.1 and 1.3 meters. In the preferred embodiments, they are substantially 1.2 meters long.

The anchoring means can take various forms, in particular:

an elongate formation extending between peaks of the wave form on the cured material side of the arris members and/or individual formations at least partially bridging neighbouring peaks of the wave form on the cured material side of the arris members and extending further from the arris members between the peaks and/or individual formations extending from and connecting intermediate portions of the wave form.

Further the anchoring formations can be similarly shaped to the wave form. In one embodiment, the arris members and the anchoring formations jointly are generally hexagonal in plan view. Also, the anchoring means of each arris member can comprise different formations at different levels, in particular two levels with:

U-shaped formations, preferably open-top, extending out from the arris member at an upper level and an elongate anchor strip spaced from the arris member at a lower level and connected thereto by fingers.

The support adaptations could be provided on the peaks. However, we prefer to provide them on the anchoring formations, to space them locally from the arris members, whereby the curable material can form a reasonably-homogeneous, finger blocks immediately behind the arris members.

The support adaptations and the adjustable supports can take varying forms, for instance:

the support adaptations can be apertures in the anchoring formations and the adjustable supports can be threaded members, preferably bolts with pairs of nuts, engaged with the apertures;

the support adaptations can be threaded apertures in the anchoring formations and the adjustable supports can be threaded members, preferably bolts, engaged with the apertures;

the support adaptations can be apertures, preferably threaded, in the anchoring formations and the adjustable supports can be feet fastenable to the formations as by bolting or clipping and having distal end apertures, whereby they can be adjustably held by means of a fixture such as a screw;

the support adaptations can be apertures in the anchoring formations and the adjustable supports are of lazy-Z shape, adapted to be secured to the anchoring means at one end and held by means of a fixture such as a screw. The above forms are principally of advantage in support the arris protection joint in a cavity to be repaired, with the top of the joint flush with the surroundings;

the support adaptations are clip receptacles and the adjustable supports are steel pins engageable with clips themselves engageable with adaptations of the anchoring means and preferably wherein the clips are of steel and sufficiently long to allow their welding in situ to the pins without damaging the function of the support adaptations. This arrangement is particularly suitable for use in a movement joint. Whilst the construction joint can be of full depth for a certain nominal thickness of concrete slab, a sub-base may not be fully flat and/or a slightly greater nominal thickness may be called for.

Again particularly for use in a movement joint, the arris protection members can have complementary end formations and clips to hold lengths of joint together at the complementary end formations.

Also for a movement joint, at least one dowel can be included per length of joint, the dowel extending transversely at dowel apertures through the arris members for maintaining the cured material on either side of the joint level in use, the dowel preferably having a sleeve over one of its ends extending from the arris members.

The following dowel features can be provided:

the or each dowel can pass through the arris members with a sliding fit in the depth direction, laterally of the length of the arris members;

the dowel can pass through the aperture in one of the arris members with a sliding fit with the dowel in the longitudinal direction of the arris members and the dowel aperture in other arris member can allow movement of the dowel in the longitudinal direction;

the or each dowel can be slidingly engaged with the anchoring means to one side of the arris members in the direction of the dowel transversely of the arris members, the engagement being on the side of the arris members opposite from the dowel sleeve where provided, the engagement means preferably being clips integrally moulded with the anchoring means.

In the case of a repair joint, it be positioned in and supported off the bottom of a cavity to be repaired with nothing below it along the line of the discontinuity between the two slabs. In this arrangement, the repair fingers extend below the bottom of the supported joint. However, we prefer to provide a surface lowering friction between the distal ends of the fingers and the bottom of the cavity. This can be a strip of flexible material, such as preferably smooth damp-proof course material. However we prefer to provide a strip of material of sufficient stiffness that it does not deform when the joint is placed on it, whereby the distal end of the fingers are formed with an even underside able to slide over the strip.

The repair material can be of resin, filled resin or cementitious mouldable materials. Again it can be fully of polymeric resin, at least as regards its curing nature, although it can be filled with bulking material.

To help understanding of the invention, two specific embodiments and variant thereof will now be described by way of example and with reference to the accompanying drawings, in which:

FIG. 7 is a cross-sectional end view of the joint and supports as shown in

Figure 1:
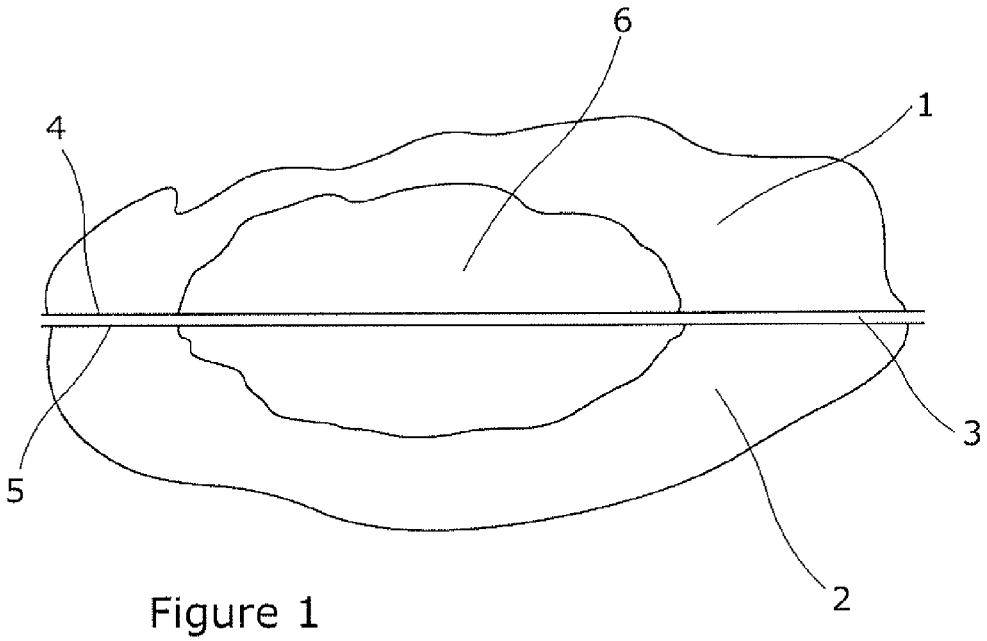
FIG. 1 is a plan view of an erosion cavity at a discontinuity between two concrete slabs.
Figure 2:
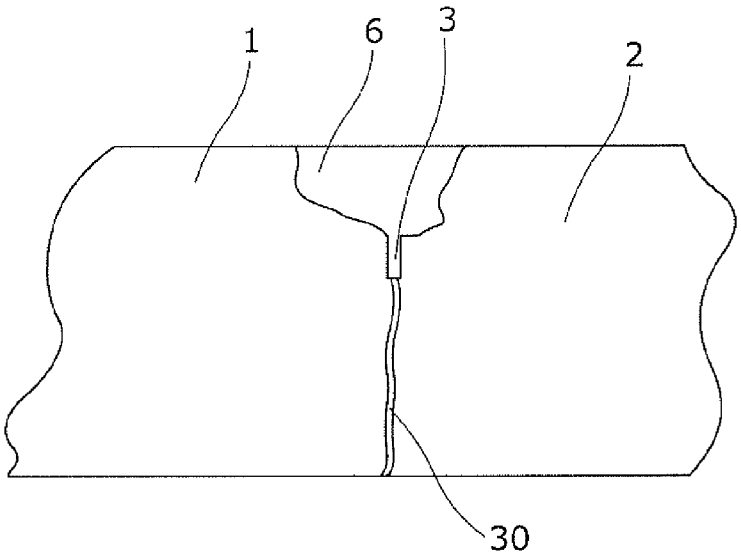
FIG. 2 is a cross-sectional view along the discontinuity at the cavity.
Figure 3:
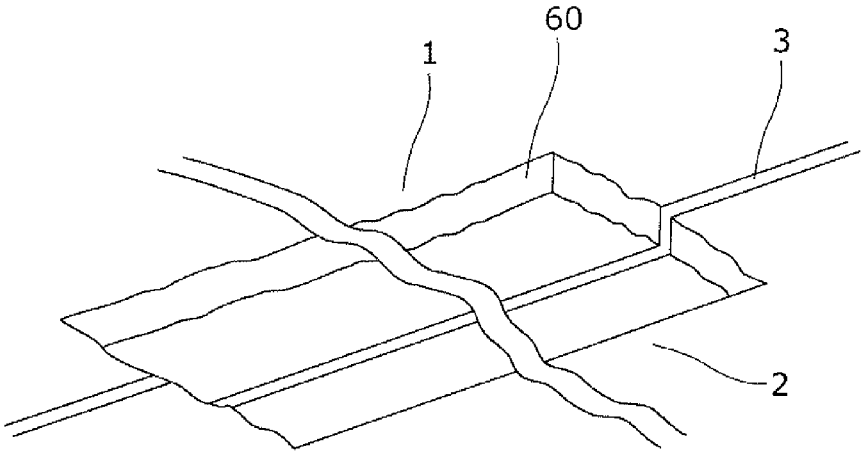
FIG. 3 is a perspective view of the cavity chiselled out for repair.
Figure 4:
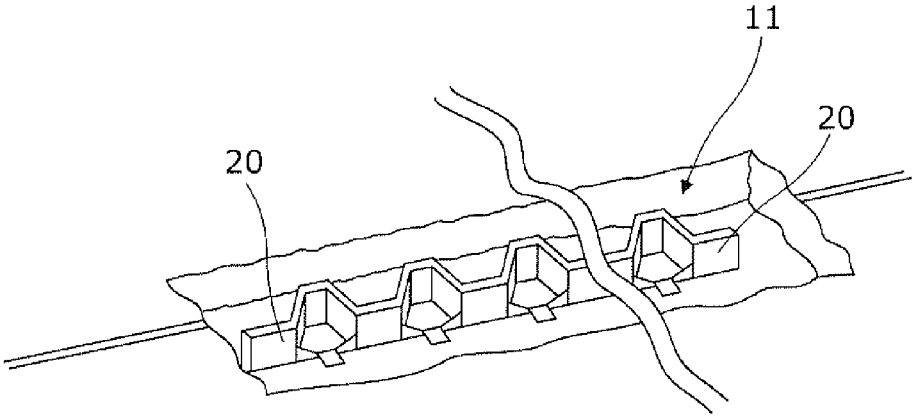
FIG. 4 is a similar view of a repair joint in accordance with the invention arranged in the cavity.
Figure 5:
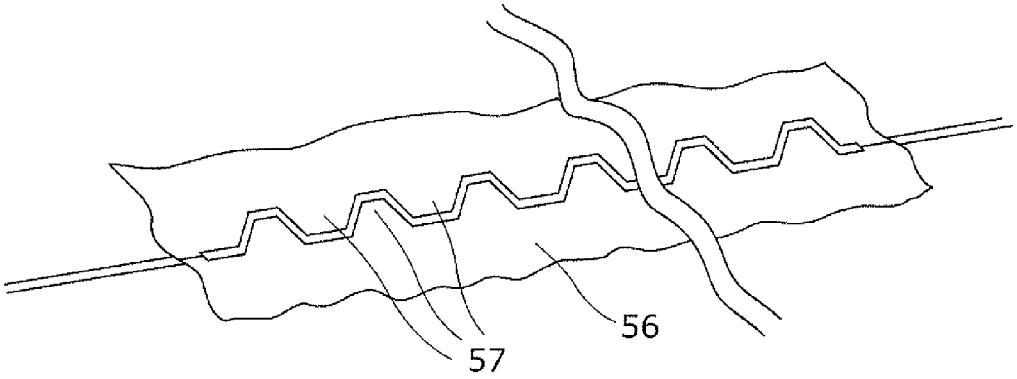
FIG. 5 is a further similar view of the cavity with the joint after filling with repair material.
Figure 6:
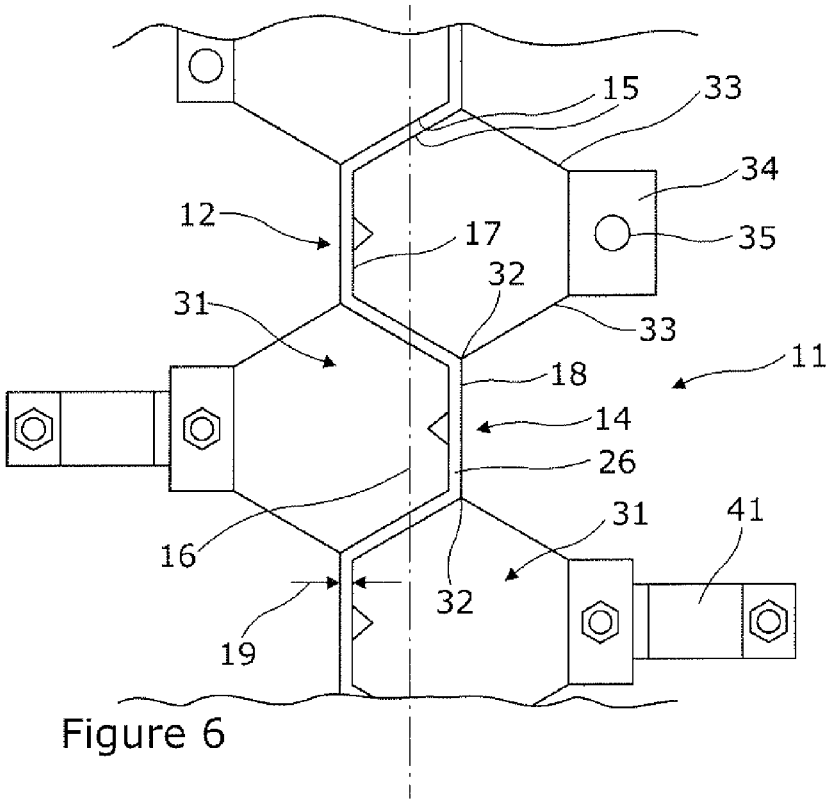
FIG. 6 is a plan view of a short portion of the repair joint of FIGS. 4 and 5, with a representative pair of supports attached.
Figure 7:
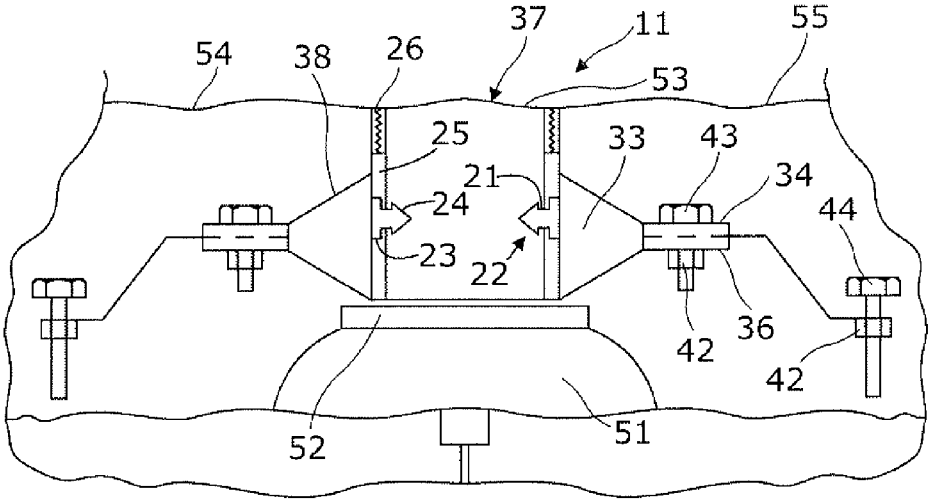
Figure 8:
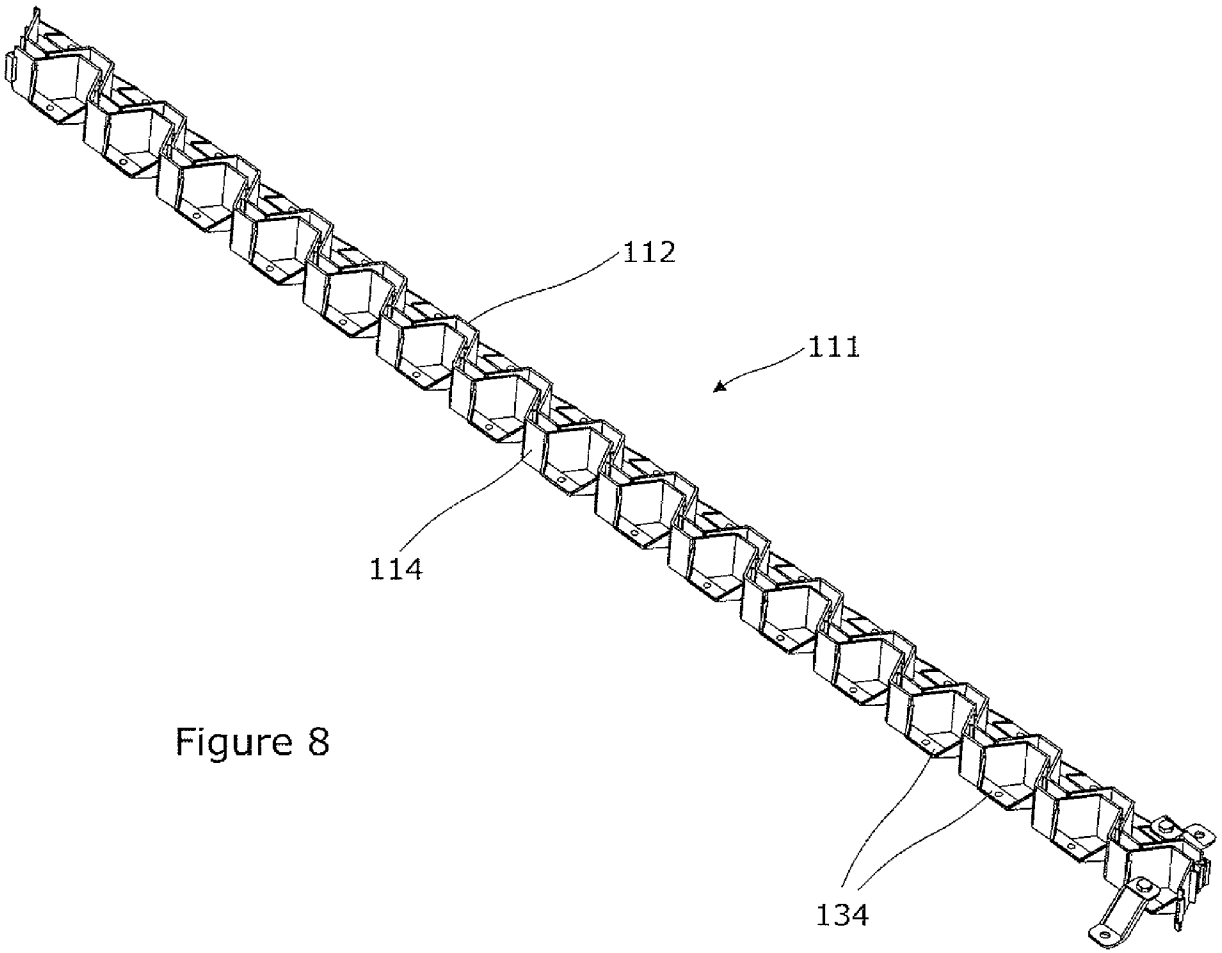
Figure 9:
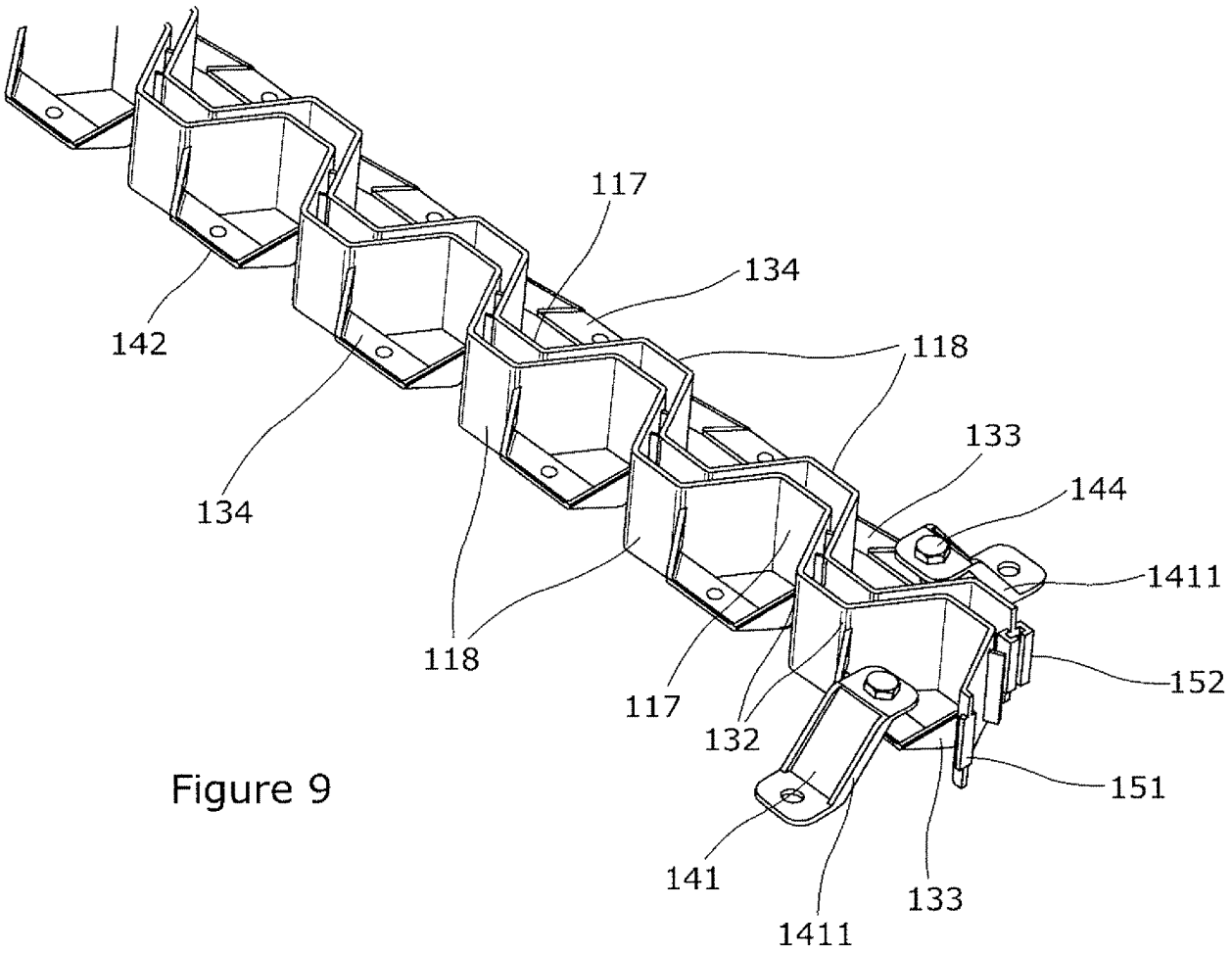
Figure 10:
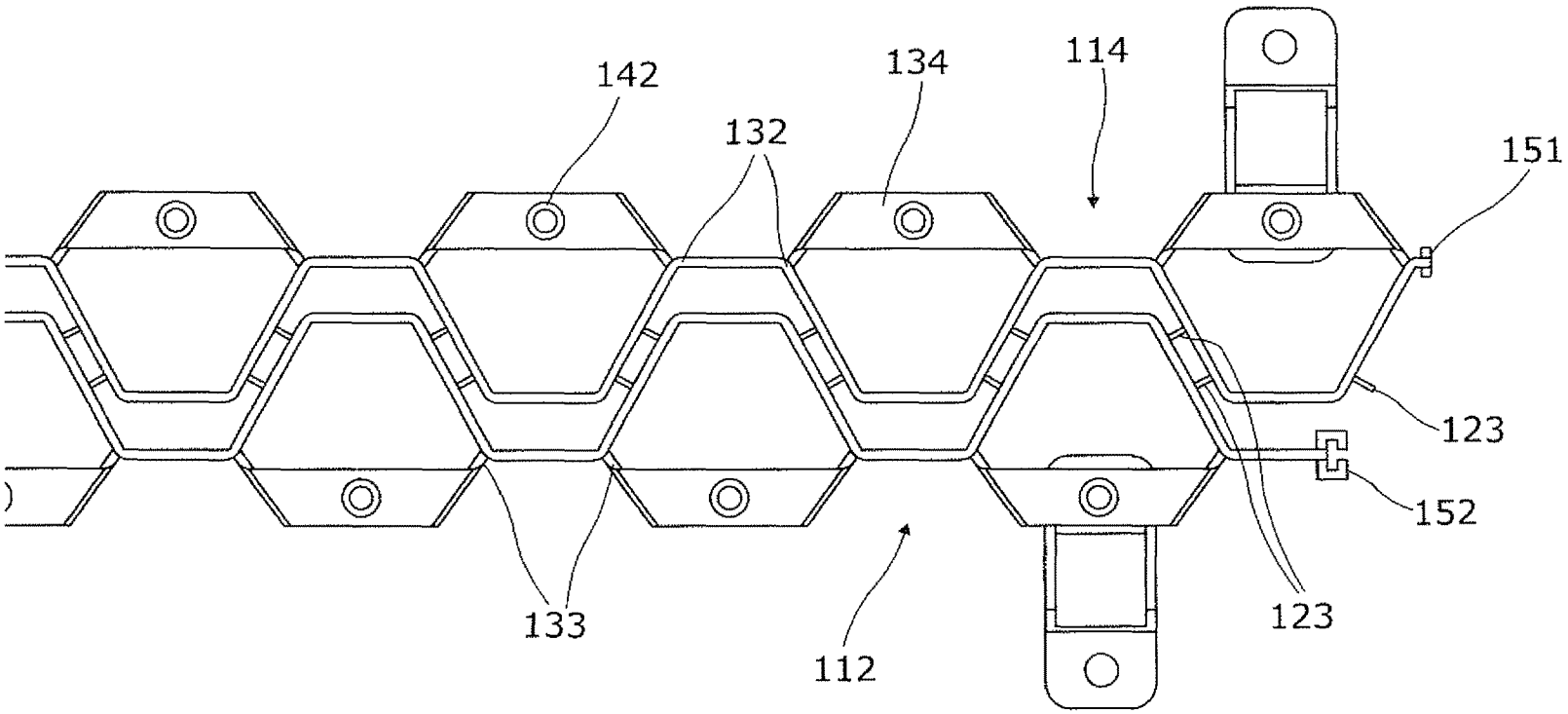
Figure 11:
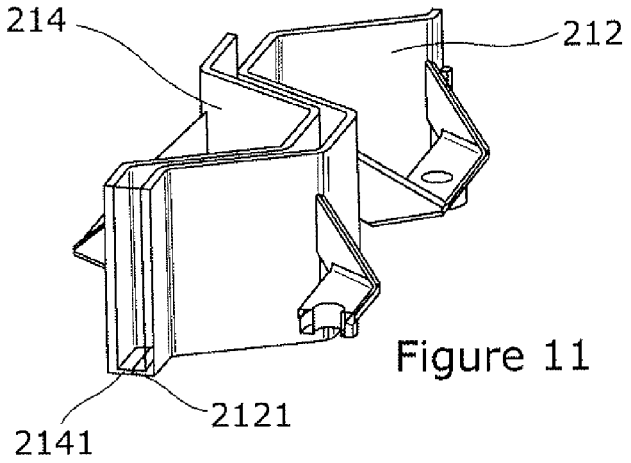
Figure 12:
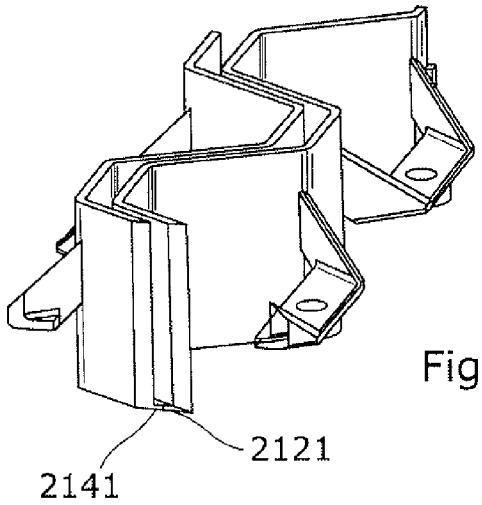
Figure 13:
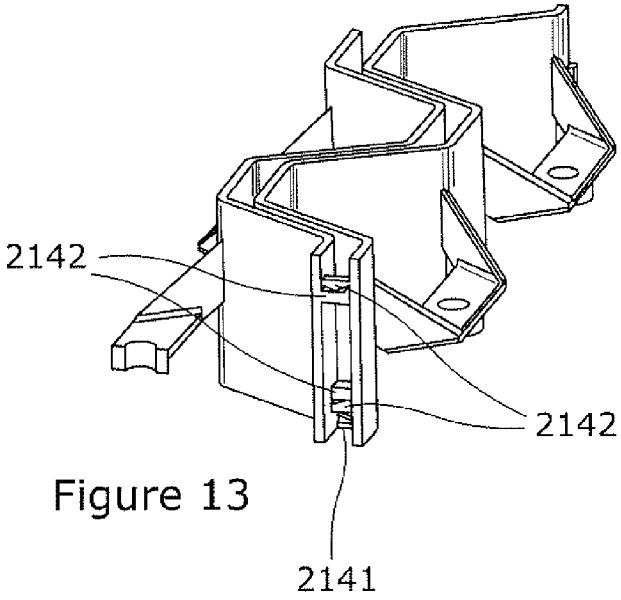
Figure 14:
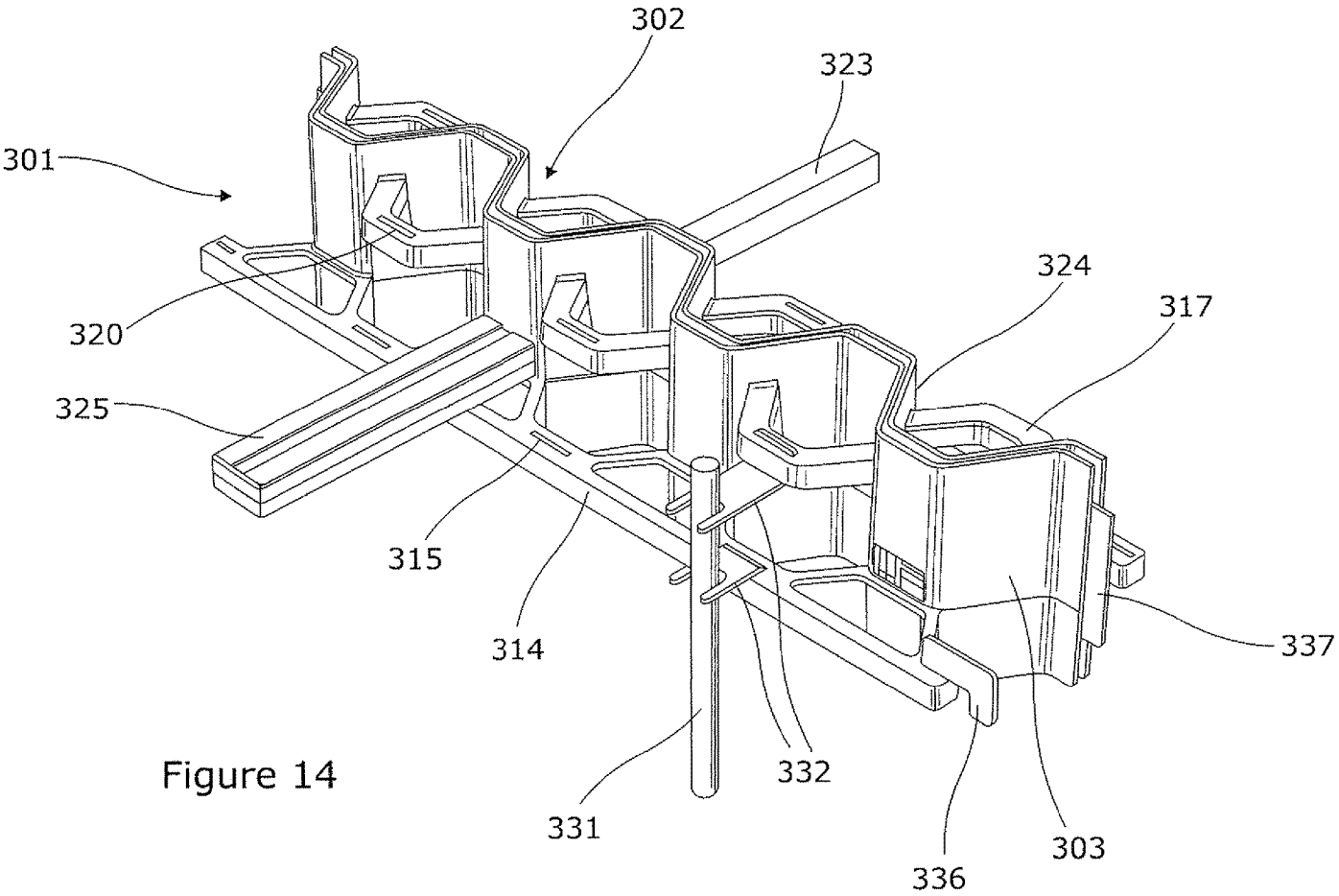
Figure 15:
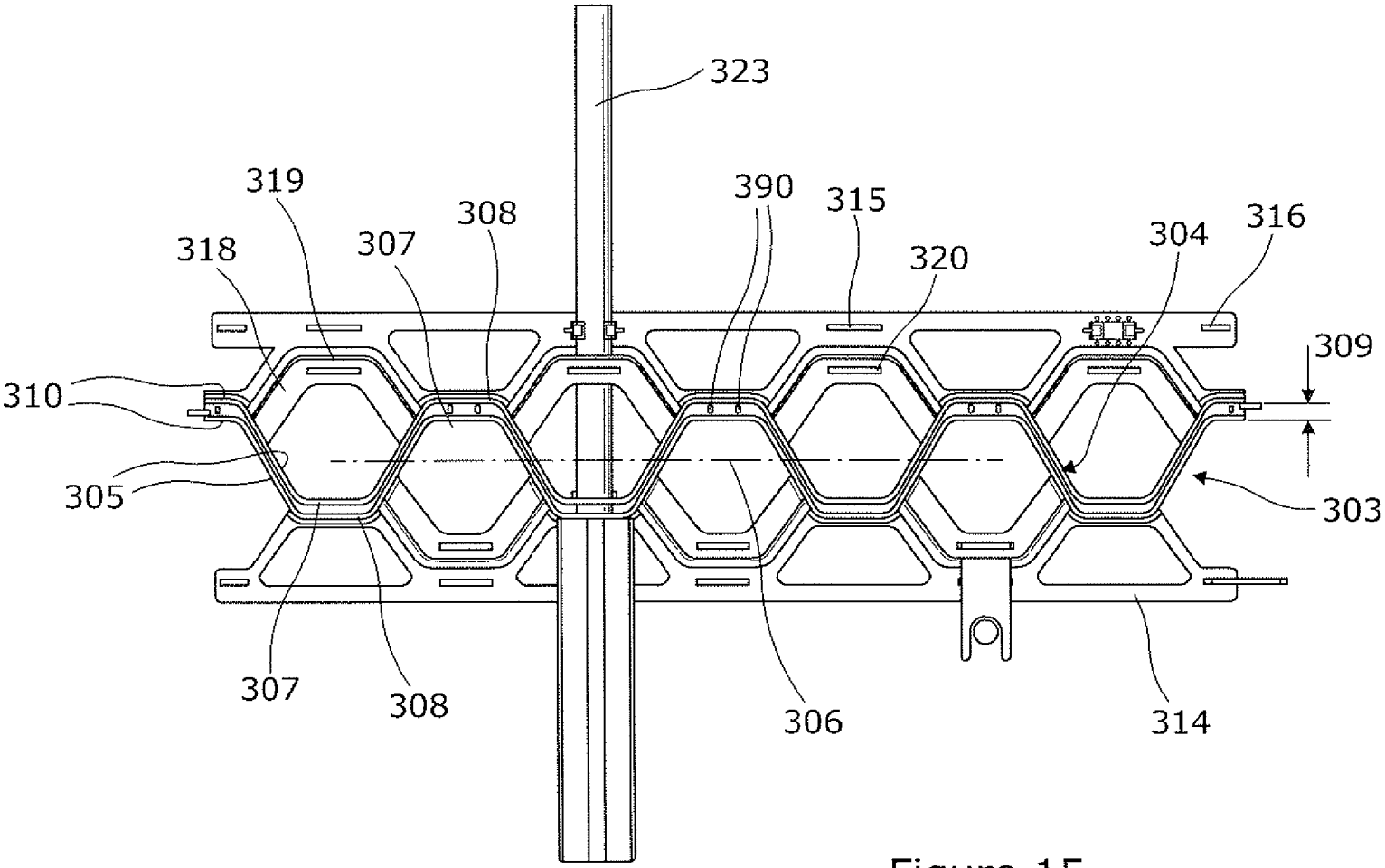
Figure 16:
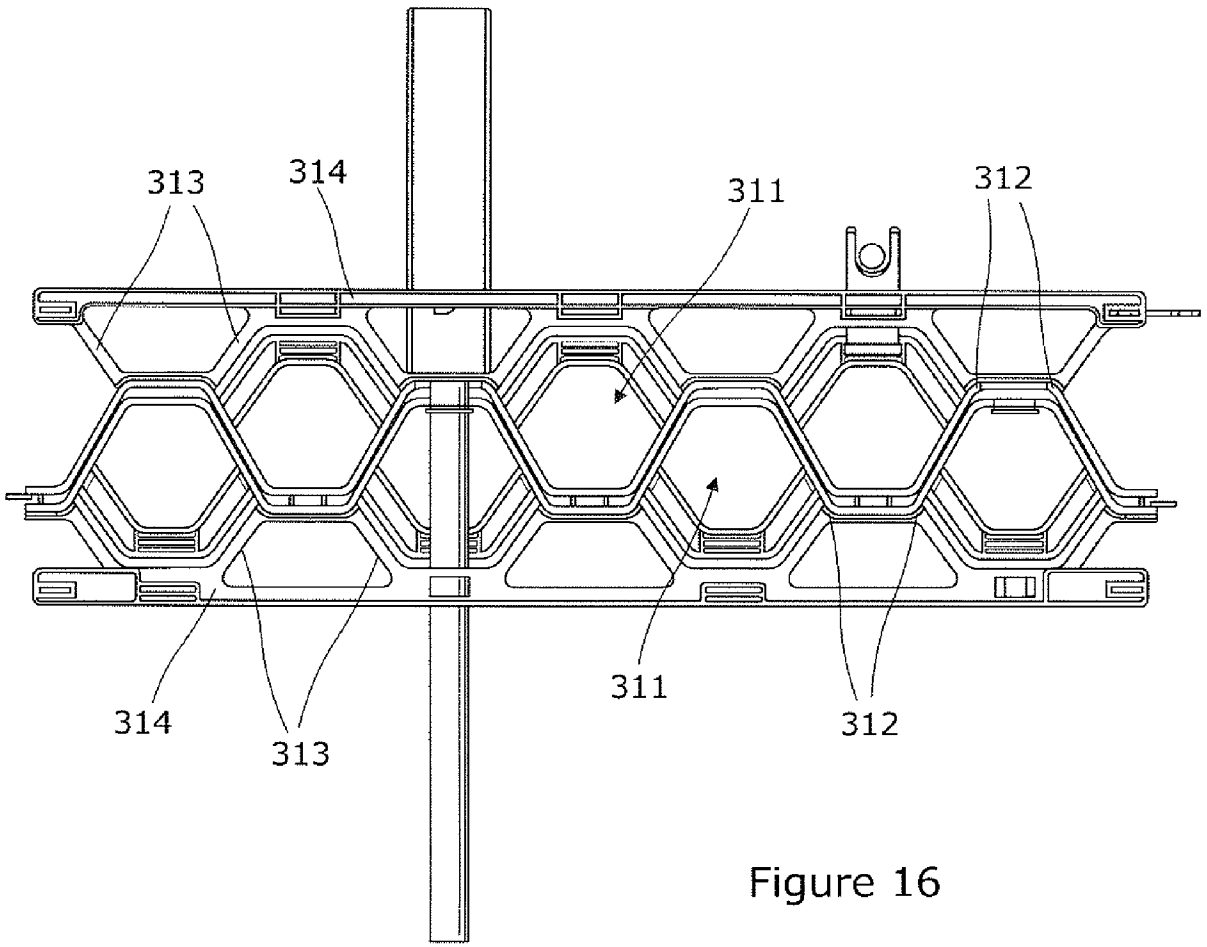
Figure 17:
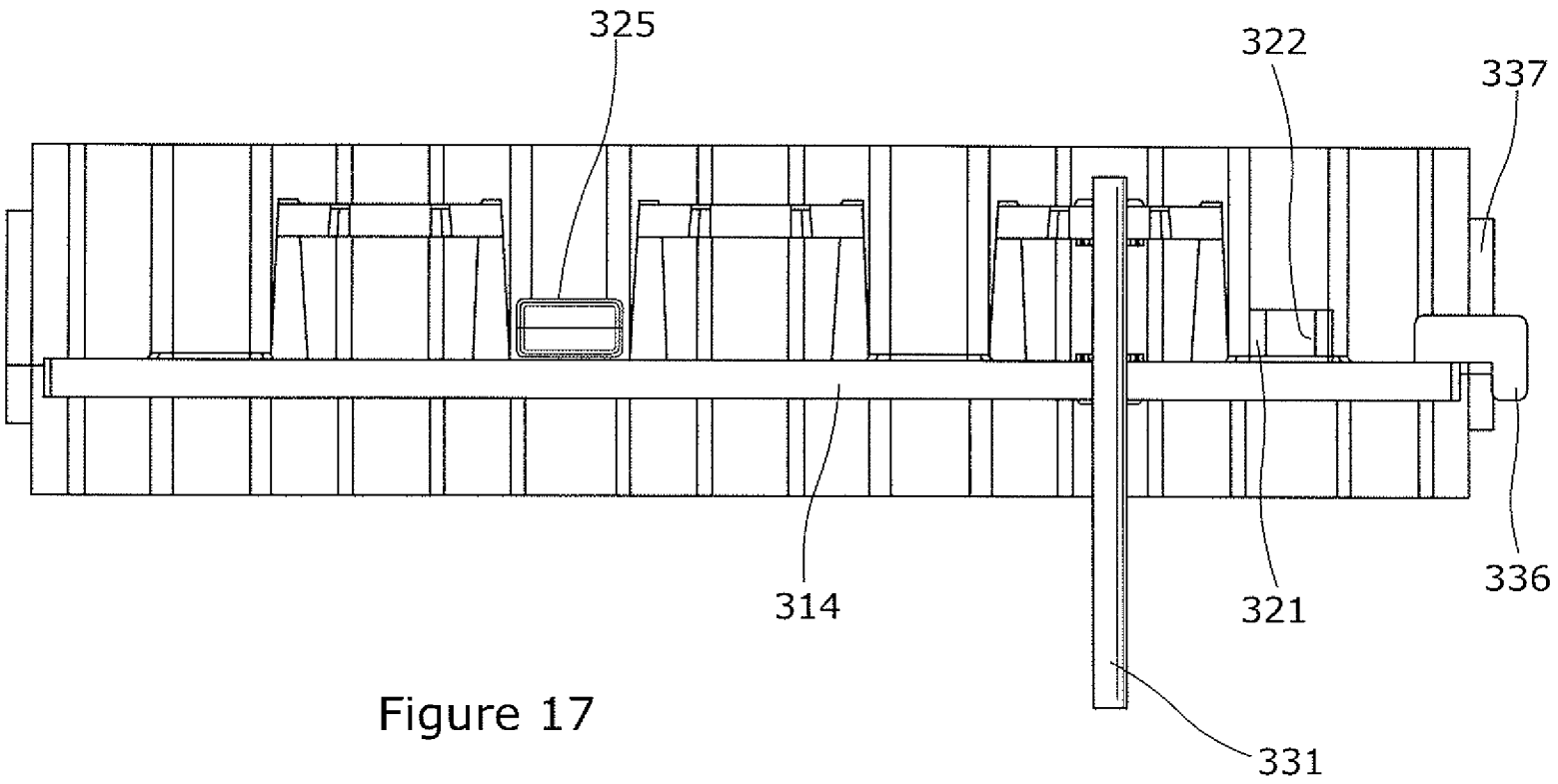
Figure 18:
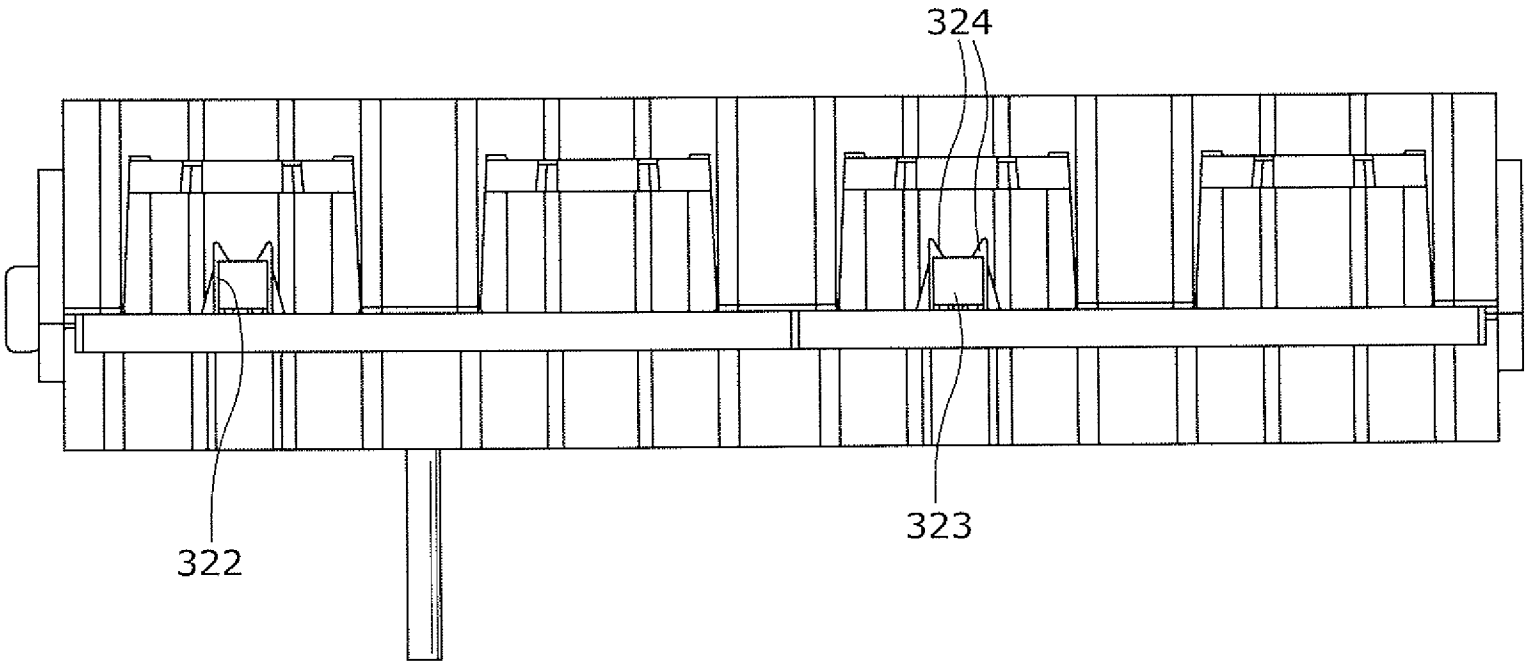
Figure 19:
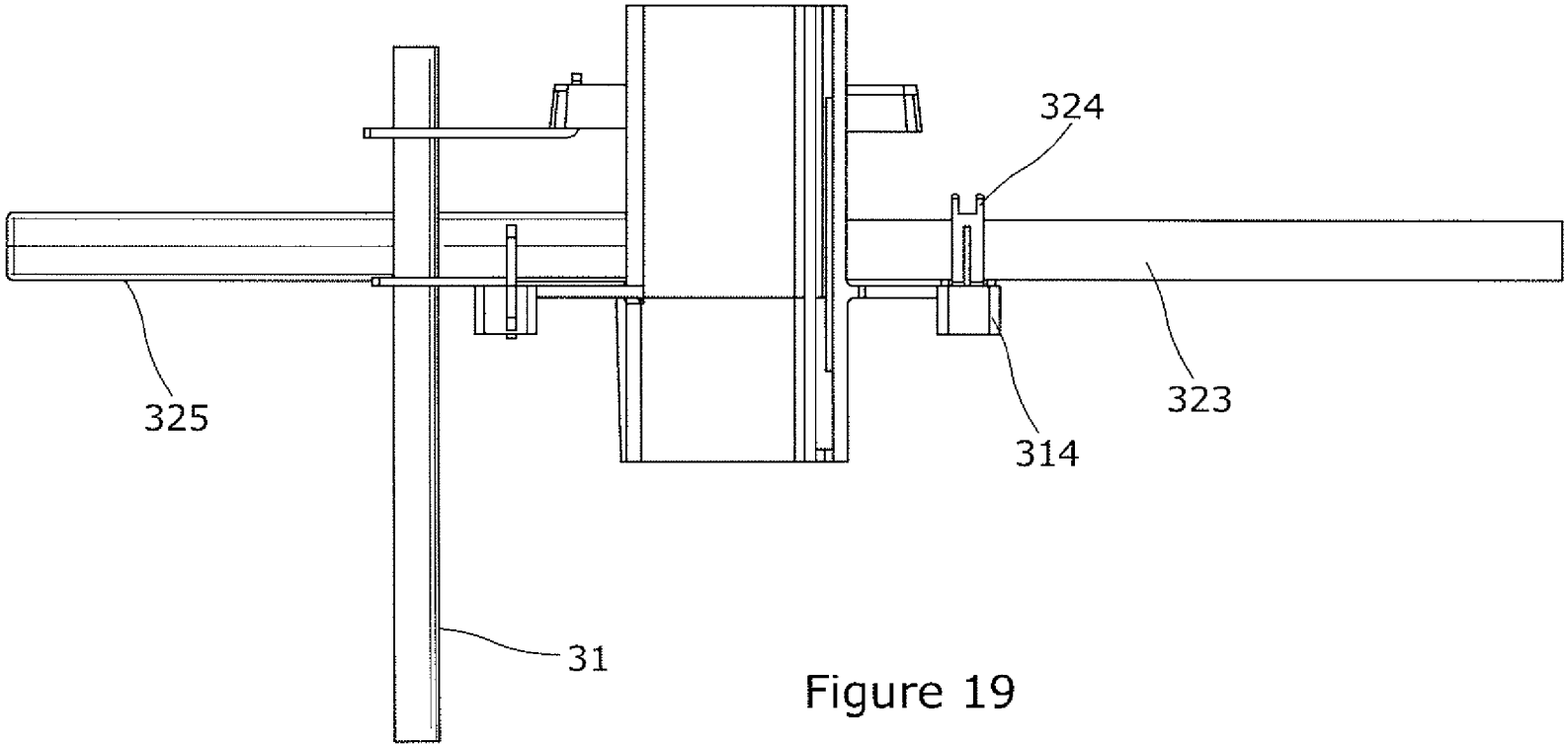
Figure 20:
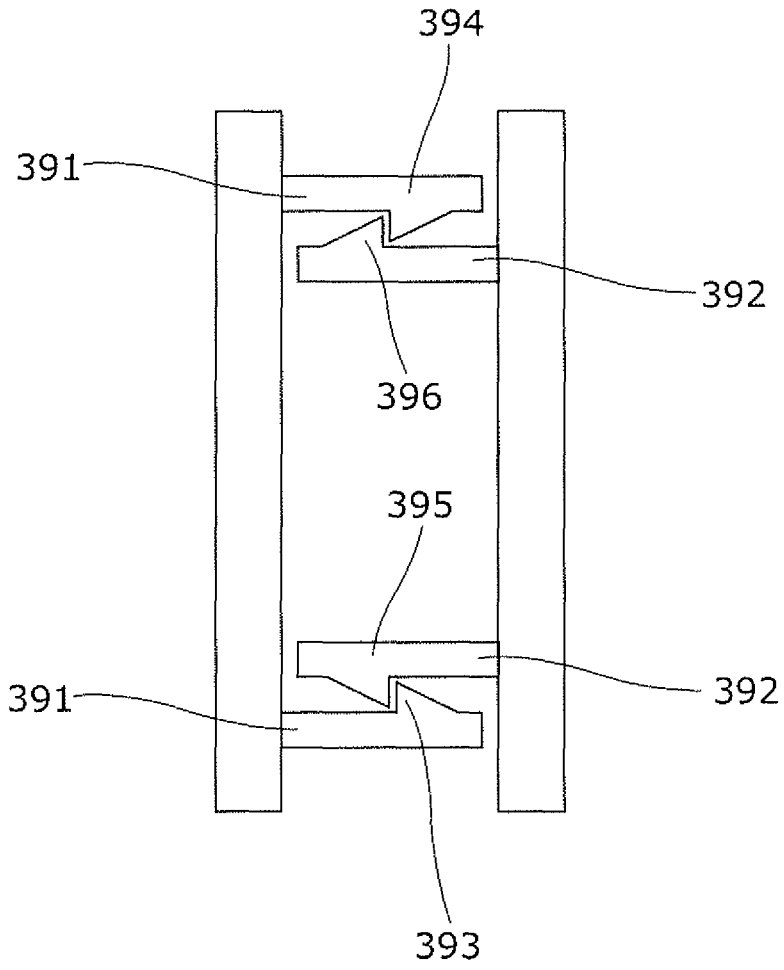

FIG. 6 arranged on the bottom of a chiselled out cavity;

FIG. 8 is a perspective view of another repair joint according to the invention;

FIG. 9 is a scrap view of one end of the joint of FIG. 8 on a larger scale;

FIG. 10 is an underside view of the end of the joint of FIG. 9;

FIG. 11 is a cross-sectional view showing clipping and resin damming features in a variant of the repair joint of FIG. 8;

FIG. 12 is another cross-sectional view showing clipping and resin damming features in the variant of the repair joint of FIG. 8;

FIG. 13 is a third cross-sectional view showing clipping and resin damming features in the variant of the repair joint of FIG. 8;

FIG. 14 is a perspective view of a representative length of a free movement, arris protection, construction joint in accordance with the invention;

FIG. 15 is an plan view of the movement joint of FIG. 14;

FIG. 16 is an underneath view of the movement joint of FIG. 14;

FIG. 17 is a one side view of the movement joint of FIG. 14;

FIG. 18 is an other side of the movement joint of FIG. 14;

FIG. 19 is an end view of the movement joint of FIG. 14;

FIG. 20 is a scrap view of inter-engaging spacers for a variant of the movement joint of FIG. 14.

Referring to FIGS. 1 to 7 of the drawings, two concrete slabs 1,2 have a crack-inducing saw-cut 3 between them inducing a discontinuity crack 30 below the saw-cut. The cut arrises 4,5 of the slabs at an area of high fork-lift truck traffic are unsupported and are liable to shear off. The more they shear away, the more their surroundings tend to erode, forming an erosion cavity 6 in the nature of a pot-hole in a road.

If such an erosion cavity is filled with ordinary concrete, or indeed more expensive fibre reinforced concrete; it will still tend to crack at the discontinuity and erode away with traffic.

For a longer lasting repair, a repair joint 11 of the invention can be used. Insofar as it consists of a product with a typical length of 1.2 m and a depth of 40 mm, the cavity is chiselled out 60 to accept it and back to total width of 180 mm, in which the joint can be with the joint arranged centrally.

The joint comprises a pair 12,14 of complementary engineering grade polymer injection mouldings. Each is based on a continuous trapezium wave shape in plan, with a constant height in side view. As shown in FIG. 6, each moulding is comprised of generally equal length oblique webs 15, set at 60° to a mid-plane 16 of the assembled joint, shorter, inner webs 17 and a longer, outer webs 18. Not only are the inner webs shorter to fit within the oblique webs of the other moulding at their attachment to the outer webs, but also the geometry is such that there is a constant 5 mm gap 19 between the opposed webs along the length of the joint. At the ends of the joint, the mouldings are provided with short webs 20 parallel to the mid-plane. The webs are 3 mm thick and the outside dimension across the outer webs is 30 mm. The skilled reader will be able to calculate other dimensions from the basic dimensions provided in this paragraph.

Centrally of each outer web 18 is an aperture 21 and centrally of each inner web is a pin 22 with a step 23 and a pointed head 24. The heads of one moulding clip into the apertures of the other whilst the steps determine their separation gap 25. A foam strip 26 extends above the pins to close the gap 25.

The trapezium wave shape of the joint provides re-entrants 31 from the plane of the outer webs 18 towards that of the inner webs. Outwards of the re-entrants from the corners 32 between the outer webs and the oblique webs 15, extend anchoring formations 33. Behind each re-entrant these formations are joined by a tab 34. The arrangement of the webs, formations and the tabs is generally regular-hexagonal. The tabs are each provided with an aperture 35 and have edge flanges 36, which are oblique continuations of the anchoring formations. To provide continuity of repair material at the corner 32 in its top region 37, the top of the formations is set down by a third of the depth of the repair joint. The tops 38 of the formations slope down to two thirds of the depth to provided that in use they are fully covered by repair material.

Supports 41 are provided to support the repair joint off the bottom of the cavity via the tabs 34. The supports are of lazy-Z shape, with threads 42 formed at both ends. At the tabs, bolts 43 through the tab apertures 35 and secure the supports to the tabs. Further bolts 44 are engaged in the distal ends of the supports and hold the supports and the joint off the bottom of the cavity.

In use, a fillet 51 of repair material is run along the discontinuity between the slabs at the bottom of the cavity. A strip 52 of 3 mm thick plastics material is laid along the fillet and the repair joint is pressed down onto it to bring its top 53 flush with or just proud of the top surface 54,55 of the concrete slabs. In this position, the bolts 44 are wound down to bear against the bottom of the cavity for support of the joint during placement of further repair material 56, without further compression of the fillet and dropping the joint below the top of the slabs.

The entire cavity is filled with repair material including the re-entrants 31. Here the material forms interdigitated fingers 57, separated by the joint, including its foam. The fingers extend down for the depth of the joint and are supported from below by the strip 52 and the fillet material 51.

If need be, trowel marks and any possible slight proudness of joint can be ground/polished off. The repair material can be cementitious or part cementitious and part polymeric resin curing material.

Thus once the repair material is fully cured, the load of traffic, for instance of fork lift trucks, across the repair is supported as the trucks etc. passes over the joint. Should the slabs move towards or away from each other across the discontinuity, or longitudinally of it, the fingers are able to move relatively with the slabs. The foam accommodates this movement. The result is that the traffic load is progressively supported from one joint to the next as it crosses the joint, without sudden—erosion causing—load transfer as occurs when the discontinuity is straight at the top surface of the slabs.

Referring now to FIGS. 8 to 10, the repair joint 111 thereshown is generally the same length as that of FIGS. 1 to 7, i.e. 1.2 m, but can be shallower and narrower. Its depth can be only 25 mm and its anchoring formations can be less than half hexagonal. It is comprised of two complementary injection mouldings 112,114.

In more detail, its tabs 134 are trapezium shaped with a lesser width to length aspect ratio than the main webs 115, 117, 118. The tabs extend close to the corners 132 and are connected to them by 60°, triangular flanges 133 extending up from the tabs to the corners. Threaded bosses 142 extend below the tabs. The supports 141 are similar to those 41, except that they are provided with edge flanges 1411. This arrangement enables the distal ends of the supports to be fixed to the bottom of the cavity, as by wall plugs and self-tapping screws. Bolts 144 engaging in the proximal ends of the supports and the threaded bosses can be used to draw the joint up flush or just above the level of the concrete slab tops. If need be, the floor of the cavity can be skimmed with repair material to raise the supports locally. Also if need be where the discontinuity has opened wide, a plastics or steel strip can be laid over it.

The opposed oblique webs 115 are provided with ribs 123 for maintaining the spacing of the mouldings 112,114. The ribs are unsupported and as such are able to crush in event of expansion of a repaired cavity, such as on heating to ambient temperature of a cold store floor following repair whilst the floor is cold. The ribs can be provided closer together than shown in the Figures whereby prior to use they inter-engage, with one rib on one moulding between two on the other. Such ribs can be inter-engaged by sliding one moulding down the other at the desired spacing. A bottom can be provided across the lower ends of the pairs of ribs to provide for the sliding to be stopped with the two mouldings at their use position.

Turning to FIGS. 11, 12 and 13, the joint there shown in successive cross sections has mutually abutting lower lips 2121,2141 on the mouldings 212,214. Their purpose is to provide a dam against repair material flowing into the gap between the mouldings when it is poured into the cavity. This allows low viscosity resin repair materials to be used. Also shown in FIG. 13 are respective hook formations 2122,2142 on the opposed mouldings for clipping them together for handling and placement as a single unit.

The wave form of the mouldings can be continued to the ends of the mouldings, which can be provided with inter-engaging formations 151,152, to enable two lengths of the joint to be connected end to end.

The repair material envisaged for this embodiment with its shallow depth a fully polymeric curing material. Typically it will be a two pot material which is sufficiently fluid to be applied by pouring to fill the cavity with the minimum of working to achieve good wetting of the cavity & bonding to the concrete material of the slabs being repaired and complete filling flush with the surface of the concrete.

The resin can be chosen to provide that the interdigitated fingers, whilst only comparatively shallow, are still strong in resisting breakage, as might be expected of similar sized cementitious fingers, in view of the improved tensile strength of suitable resin material vis-à-vis cementitious material.

Suitable polymeric resins are likely to be an epoxy or methyl methacrylate resin. Polyurethane resins also may be suitable, with a primer first applied to the concrete of the cavity.

The invention is not intended to be restricted to the details of the above described embodiment. For instance, alternative wave formations can be used for the arris members, such as sinusoidal or triangular. The clipping of the moulding can configured differently, possibly by one moulding having top and bottom lips gripping the other across the width of the foam. The detailed design of the anchoring formations, tabs and supports can be changed.

Referring to FIGS. 11 to 19 of the drawings, a representative length of a free movement, arris protection, construction joint in accordance with the invention comprises two arris members 301, 302 formed as injection mouldings of glass filled nylon polymer. Each has an arris member 303, 304, each of which in turn is comprised of generally equal length oblique webs 305, set at 60° to a mid-plane 306 of the assembled joint, together with shorter, inner webs 307 and longer, outer webs 308. Not only are the inner webs shorter to fit within the oblique webs of the other moulding at their attachment to the outer webs, but also the geometry is such that there is a constant 5 mm gap 309 between the opposed webs along the length of the joint. In particular this is determined by spacers 390 moulded to the inside of one of the inner webs. At the ends of the joint, the mouldings are provided with short webs 310 parallel to the mid-plane.

The trapezium wave shape of the joint provides re-entrants 311 from the plane of the outer webs 308 towards that of the inner webs. Outwards of the re-entrants from the corners 312 between the outer webs and the oblique webs 305, extend anchoring fingers 313. Spaced from each re-entrant these fingers are joined by an elongate anchor strip 314. The arrangement of the webs, formations and the strip is generally regular-hexagonal. The strips are provided with a respective slot 315 opposite each re-entrant and including an end slot 316 at each end of the strip. The fingers and strips are provided somewhat below half the height of the arris members.

At a higher level and extending from within the re-entrants, i.e. set in from the corners 312, extend out splayed U shaped anchors 317 with their angled limbs 318 and their parallel limbs 319 forming hexagonal shapes with the portions of the webs on their insides. These anchors do not extend as far from the arris members as the anchor strips below them. Their parallel limbs 319 also have slots 320.

Certain of the webs 307,308 have dowel apertures 321, 322 for square steel bar dowels 323. As shown, the apertures 321 are provided in the outer webs of one of the arris members and the apertures 322 are in the corresponding inner webs of the other arris member. The aperture 322 in the outer webs are sized to provide a sliding fit for the dowel bars. In particular these apertures provide location for the dowel bars both longitudinally of the arris members and transversely of them, that is to say in the widthwise direction of the arris members, which is in the direction of their depth in the use orientation. The apertures 321 are also provide such location in the transverse direction, but are longer in the length direction of the arris members, in order not to limit relative displacement of the concrete slabs in use as the latter shrink on curing.

On the anchor strip of the arris member having smaller, inner aperture 322, in a position to locate a dowel at right angles to the mid-plane 306 of the joint, the strip 314 has a pair of clips 324 for holding the dowel to the strip. A plastics material, dowel sleeve 325 is provided on the other end of the dowel.

With the arris members of both sides of the joint abutted at the spacers and with dowels inserted at regular positions along the joint, bearing in mind that the drawings show only a representative portion of a joint, it is held together by friction of the dowel sleeves on one end of the dowels and friction of the clips on the other ends of the dowels.

To hold the joint at a desired position with respect to a sub-base, prior to concrete pouring (neither of the sub-base nor the concrete being shown in the drawings) steel pins 331 can be provided, driven into the sub-base. These are connected to the joint by L-pieces 332, having cut-outs 333 in the ends of their long limbs 334, with their short limbs 335 engaging in the slots 315, 320. One short limb faces up and the other down. The L-pieces and the pins are conveniently welded together in situ, welding equipment normally being available on site where concrete slabs are being laid. The length and thinness of the limbs is such that welding at the pins does not cause polymer melting at the slots.

The movement joint will normally be used in lengths adjoined to each other by staple like clips 336 engaging in slots 316 at abutting end of the strips. The ends of the arris members have end tabs 337, which provide for the mid-planes of adjoining lengths to be aligned.

The invention is not intended to be restricted to the details of the above described embodiment. For instance, the spacers 390 could be provided on both arris members and configured to inter-engage and hold the arris members and the joint together. FIG. 20 show a possible arrangement in which one arris member has a pair of spacers 391 with respective upwards and downwards facing barbs 393, 394 the other having a spacer pair 392 with barbs 395, 396 facing in the opposite directions. The barbs inter-engage on abutment of the arris members and hold the joint together until concrete shrinkage pulls them apart. Separate inter-engaging formations and spacers could be provided.

What is claimed is:

1. An arris protection joint for edging the arrises of cured material pourable on opposite sides of the joint prior to curing, the joint comprising:

an opposed pair of elongate arris members for edging the cured material, the arris members being:

complementarily formed along their length with a wave shape, with each member extending across a mid-plane of the joint from one side of the joint to the other side of the joint and back again at successive positions along the joint, whereby on pouring of a curable material it is formed into inter-digitated fingers edged by the arris members and extending through the depth of the curable material, corresponding to a width of the arris members, and the arris members having:

means for anchoring them in a respective repair material on opposite sides of the joint and support adaptations being apertures with adjustable supports engaged within the support adaptations to provide the arris members support in a cavity with their tops at least substantially flush with concrete slabs and the arris members are of moulded polymeric material and the arris members have integrally moulded spacers for holding them at a separation from each other.

2. An arris protection joint according to claim 1, wherein the wave form is regular and each arris member's extent across the mid-plane is regular.

3. An arris protection joint according to claim 1, wherein an arris members spacers for holding the arris members at a separation maintains a separation.

4. An arris protection joint according to claim 3, including a filler between a top-in-use edges of the arris members.

5. An arris protection joint according to claim 3, wherein the spacers comprise complementary clips for holding the arris members together prior to use.

6. An arris protection joint according to claim 1, wherein the wave form is constant across the width of the arris members, providing in use interdigitated fingers of cured material having a constant depth, or the wave form varies across the width of the arris members, providing a varying form to the interdigitated fingers.

7. An arris protection joint according to claim 1, wherein the arris members are injection moulded with a length between 1 and 1.5 meters, and/or the arris members are moulded of filled polymer, such as glass filled nylon.

8. An arris protection joint according to claim 1, wherein the anchoring means comprises an elongate formation extending between peaks of the wave form on the cured material side of the arris members.

9. An arris protection joint according to claim 8, wherein the anchoring means of each arris member comprises formations at two levels:

a. U-shaped formations, extending out from the arris member at an upper level and b. an elongate anchor strip spaced from the arris member at a lower level and connected thereto by fingers.

10. An arris protection joint according to claim 8, wherein the anchoring formations have a support adaptations.

11. An arris protection joint according to claim 10, wherein:

a. the support adaptations are apertures in the anchoring formations and b. there are provided an adjustable supports which are threaded members, preferably bolts with pairs of nuts, engaged with the apertures, or c. the support adaptations are threaded apertures in the anchoring formations and d. the adjustable supports are threaded members, preferably bolts, engaged with the apertures, or e. the support adaptations are apertures, preferably threaded, in the anchoring formations and f. the adjustable supports are feet fastenable to the formations as by bolting or clipping and having distal end apertures, whereby they can be adjustably held by means of a fixture such as a screw, or g. the support adaptations are apertures in the anchoring formations and h. the adjustable supports are of lazy-Z shape, adapted to be secured to the anchoring means at one end and held by means of a fixture such as a screw, or i. the support adaptations are clip receptacles and j. the adjustable supports are steel pins engageable with clips themselves engageable with adaptations of the anchoring means and preferably wherein the clips are of steel and sufficiently long to allow their welding in situ to the pins without damaging the function of the support adaptations.

12. An arris protection joint according to claim 1, wherein the anchoring means comprises individual formations at least partially bridging neighbouring peaks of the wave form on the cured material side of the arris members and extending further from the arris members between the peaks.

13. An arris protection joint according to claim 12, wherein the anchoring formations are similarly shaped to a wave form.

14. An arris protection joint according to claim 13, wherein the arris members and the anchoring formations jointly are generally hexagonal in plan view.

15. An arris protection joint according to claim 1, wherein the anchoring means comprises individual formations extending from and connecting intermediate portions of the wave form.

16. An arris protection joint according to claim 1, wherein the arris protection members have complementary end formations and clips to hold lengths of the arris protection joint together at a complementary end formations.

17. An arris protection joint according to claim 1, including at least one dowel extending transversely at dowel apertures through the arris members for maintaining the cured material on either side of the joint level in use, the dowel preferably having a sleeve over one of its ends extending from the arris members.

18. An arris protection joint according to claim 17, wherein each dowel passes through the arris members with a sliding fit in a depth direction, laterally of the length of the arris members, and/or the or each dowel passes through the aperture in one of the arris members with a sliding fit with the dowel in the longitudinal direction of the arris members and the dowel aperture in other arris member allows movement of the dowel in the longitudinal direction.

19. An arris protection joint according to claim 17, wherein each dowel is slidingly engaged with the anchoring means to one side of the arris members in the direction of each dowel transversely of the arris members, the engagement being on the side of the arris members opposite from the dowel sleeve, the engagement means preferably being clips integrally moulded with the anchoring means.

20. An arris protection joint according to claim 1, including a support strip to be arranged beneath the opposed pair of arris members for providing an even underside to the interdigitated fingers whereby those on one side of the joint are able to move with respect to those on the other side.

* * * * *